US005439268A

United States Patent [19]

Dozsa-Farkas

[11] Patent Number: 5,439,268

[45] Date of Patent: Aug. 8, 1995

[54] ADJUSTABLE ARMREST ASSEMBLY FOR A CHAIR

[75] Inventor: Andras Dozsa-Farkas, München Germany

[73] Assignee: Shin Yen Enterprise Co., Ltd., Taiwan

[21] Appl. No.: 259,394

[22] Filed: Jun. 14, 1994

[51] Int. Cl.[6] ..... A47C 7/54

[52] U.S. Cl. ..... 297/411.35; 297/411.26; 297/411.34; 297/411.2; 297/411.38; 248/118.5; 403/331

[58] Field of Search ..... 297/411.35, 411.26, 297/411.34, 411.2, 411.38; 248/118.5, 918; 403/331, 395

[56] References Cited

U.S. PATENT DOCUMENTS 4,822,103 4/1989 Stenvall ..... 248/118.5 X
5,078,530 1/1992 Kim ..... 403/331 X
5,255,956 10/1993 Stevens ..... 297/411.26

*Primary Examiner*—Kenneth J. Dorner
*Assistant Examiner*—Anthony Barfield
*Attorney, Agent, or Firm*—Ladas & Parry

[57] ABSTRACT

An adjustable armrest assembly for a chair includes an elongated connector and an elongated armrest member. The elongated connector is mounted securely on the seat and has two opposite side surfaces formed with a respective open-ended horizontal slide slot. The slots are aligned with each other. The elongated armrest member has a horizontal top wall, and two generally L-shaped guide bodies disposed on two opposite side portions of the top wall. Each of the guide bodies includes a vertical plate portion secured to the bottom surface of the top wall at the top end portion thereof, and a horizontal plate portion connected securely to the vertical plate portion. The horizontal plate portions are respectively and slidably engaged within the slide slots of the connector so that the armrest member can be moved on the connector.

2 Claims, 6 Drawing Sheets

ADJUSTABLE ARMREST ASSEMBLY FOR A CHAIR

BACKGROUND OF THE INVENTION

1. Field of The Invention

This invention relates to an armrest assembly for a chair, more particularly to an armrest assembly which has two armrest members that are movable relative to the seat of the chair.

2. Description of the Related Art

Referring to FIG. 1, a conventional chair is shown to comprise a base unit 11, a seat 12, a back 14 and two armrest frames 15. Two supporting plates 151 are fastened to the bottom surface of the seat 12. The armrest frames 15 are fastened to the supporting plates 151 by lock bolts 152. When a user is sitting on the chair and is operating a computer keyboard or the like, the elbows of the user cannot be placed on the armrest frames 15. Thus, the illustrated chair is not suitable for use by a computer operater.

SUMMARY OF THIS INVENTION

It is therefore the main object of this invention to provide an armrest assembly for a chair which has an armrest member that is movable relative to the seat of the chair.

According to this invention, an adjustable armrest assembly for a chair includes an elongated connector and an elongated armrest member. The elongated connector is mounted securely on the seat and has two opposite side surfaces formed with a respective open-ended horizontal slide slot. The slots are aligned with each other. The elongated armrest member has a horizontal top wall, and two generally L-shaped guide bodies disposed on two opposite side portions of the top wall. Each of the guide bodies includes a vertical plate portion secured to the bottom surface of the top wall at the top end portion thereof, and a horizontal plate portion connected securely to the vertical plate portion. The horizontal plate portions are respectively and slidably engaged within the slide slots of the connector so that the armrest member can be moved on the connector.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
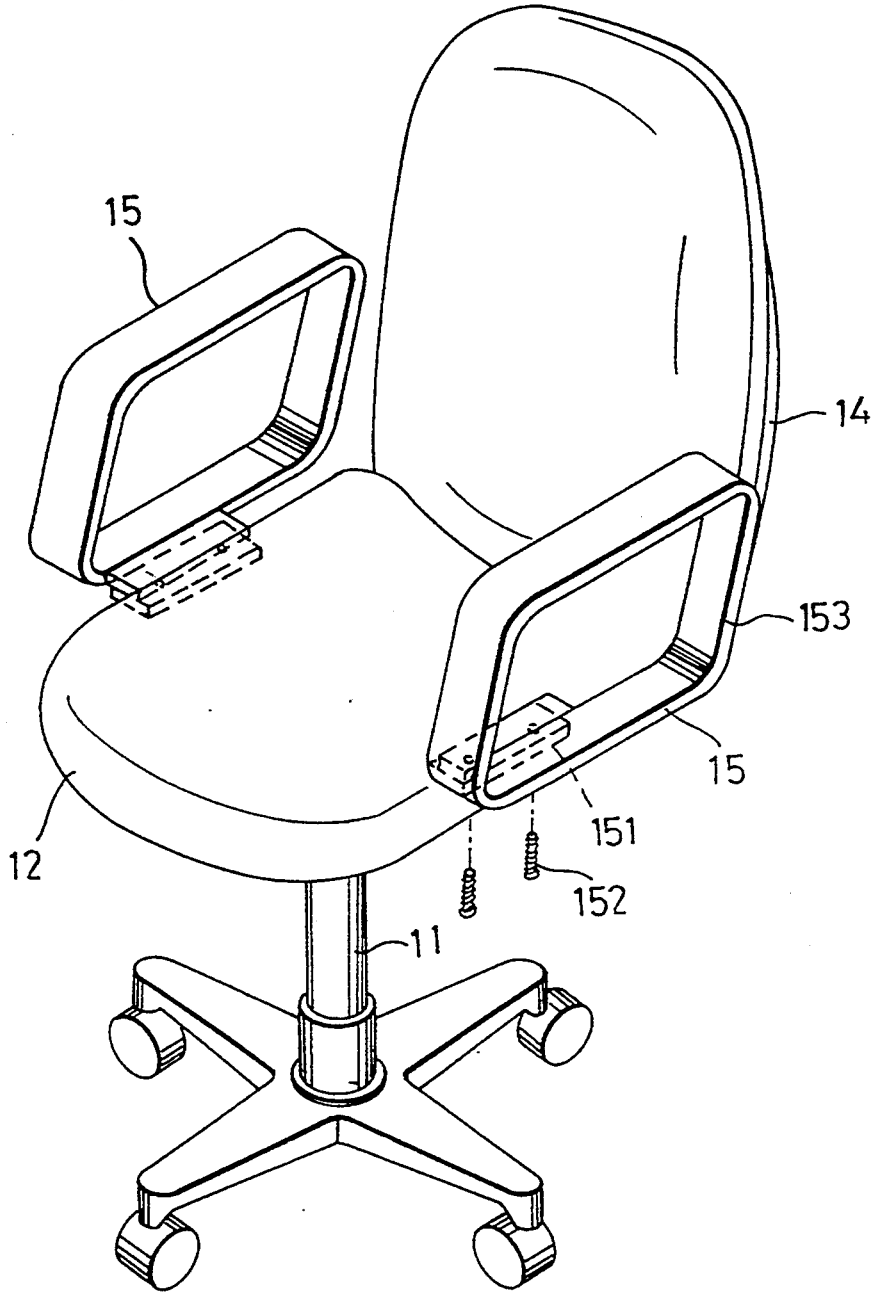
FIG. 1 (PRIOR ART)
FIG. 1 is a perspective view of a conventional armchair.
Figure 2:
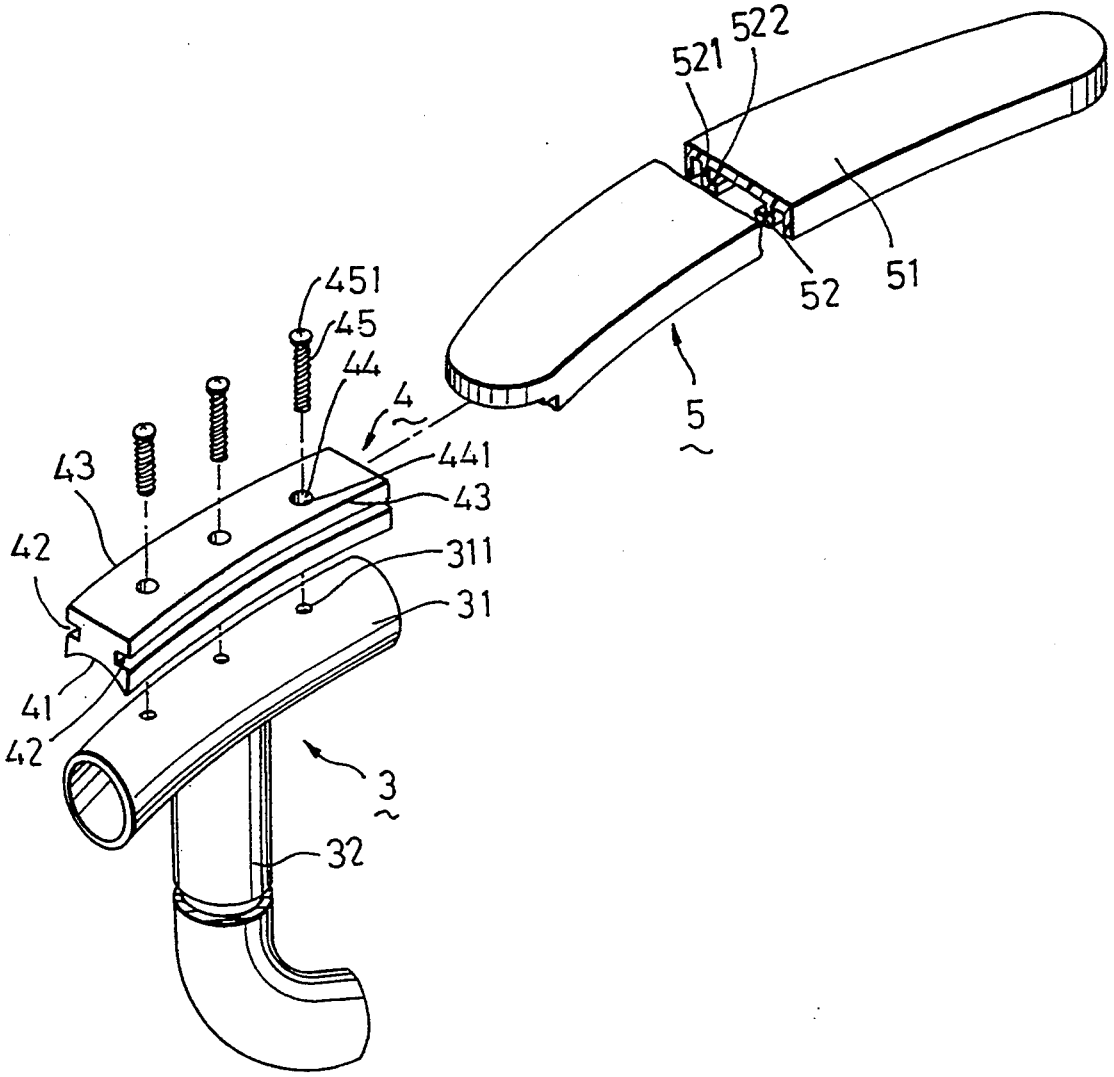
FIG. 2 is an exploded view of an armrest assembly according to this invention.

Referring to FIGS. 2 to 5, an adjustable armrest assembly for a chair 2 (see FIG. 3) according to this invention includes a generally T-shaped support tube 3 fixed on the seat 21 (see FIG. 3) of the chair 2, an elongated plastic connector 4 bolted to the support tube 3, and an elongated plastic armrest member 5 mounted movably on the connector 4.

The support tube 3 consists of a circular horizontal upper tube 31 having three vertically extending threaded holes 311 formed through the top end portion of the wall thereof, and a circular vertical lower tube 32 having an upper end connected securely to the horizontal tube 31, and a lower end fixed on the seat.

The connector 4 has a curved bottom surface 41 placed on the horizontal upper tube 31 of the T-shaped support tube 3, two open-ended slide slots 42 formed in two opposite side surfaces 43 of the connector 4, three vertically extending counterbores 44 formed through the connector 4, and three vertical lock bolts 45 extending through the counterbores 44 of the connector 4 to engage threadably within the threaded holes 311 of the support 3 in such a manner that the heads 451 of the lock bolts 45 are respectively received within the large-diameter portions 441 of the counterbores 44.

Figure 3:
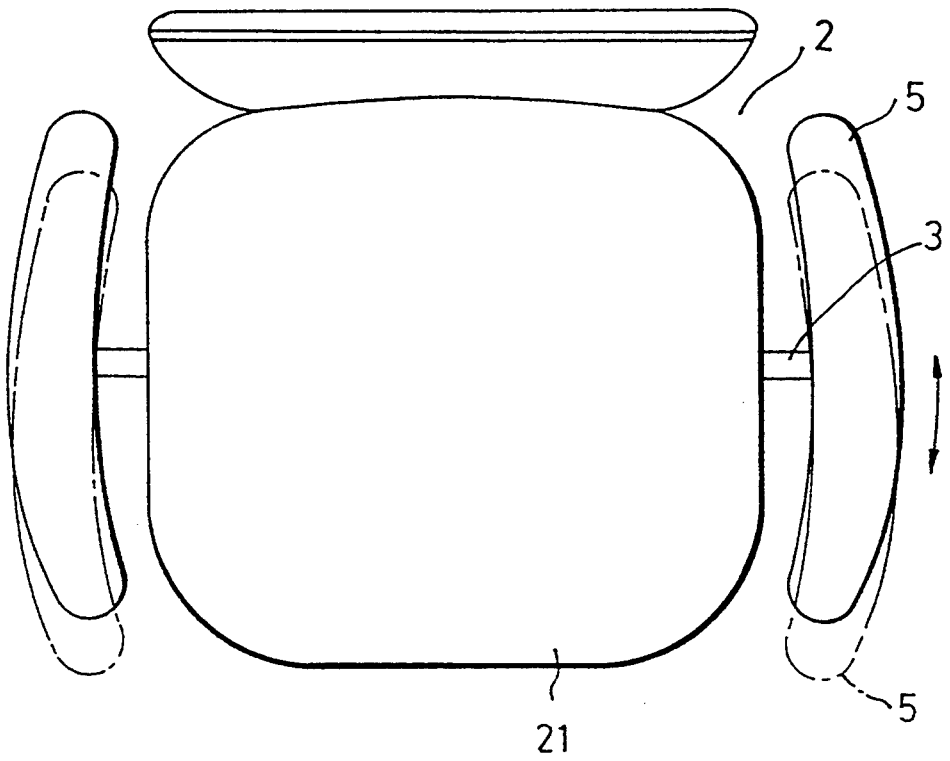
FIG. 3 is an elevational top view illustrating the adjustment of the armrest assembly according to this invention.

The armrest member 5 has a horizontal top wall 51 and two generally L-shaped guide bodies 52 disposed on two opposite side portions of the top wall 51. Each of the guide bodies 52 includes a vertical plate portion 521 secured to the bottom surfaces of the top wall 51 at the top end portion thereof, and a horizontal plate portion 522 integrally formed with the lower end of the vertical plate portion 521. The horizontal plate portions 522 of the guide bodies 52 of the armrest member 5 are engaged respectively and slidably within the slide slots 42 of the connector 4. Accordingly, as illustrated in FIG. 3, the armrest member 5 can be moved on the support tube 3.

Figure 4:
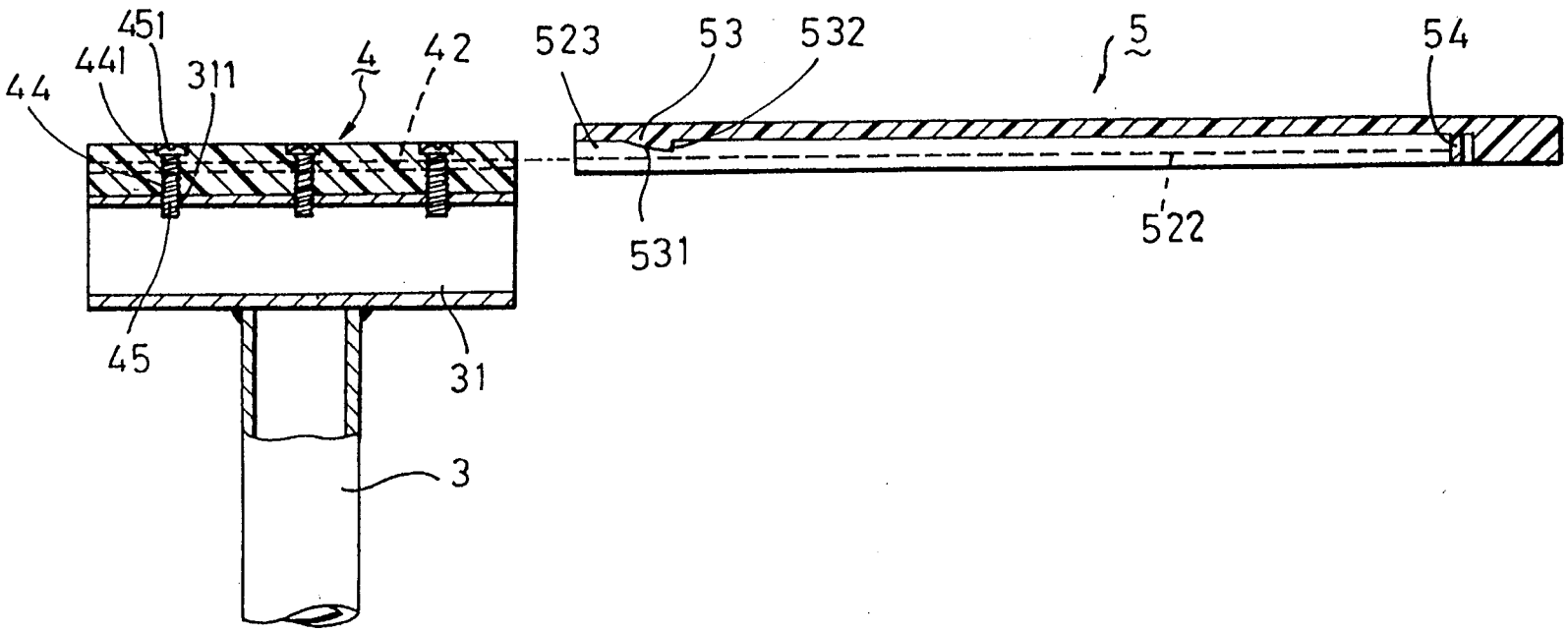
FIG. 4 is a partially exploded sectional view showing the armrest assembly of this invention.
Figure 5:
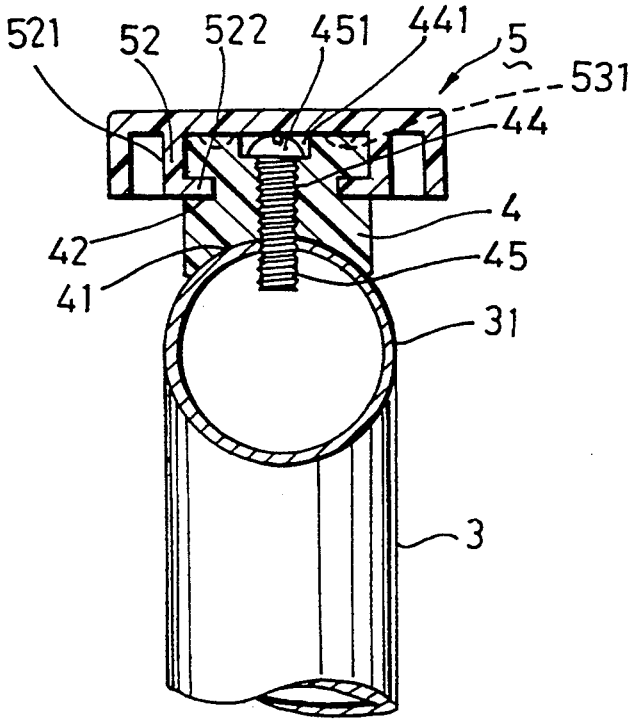
FIG. 5 is a schematic view illustrating the armrest assembly of this invention.

As best shown in FIG. 5, the armrest member 5 defines a generally T-shaped guideway 523 (see FIG. 4) therebetween. Referring to FIG. 4, the armrest member 5 includes a tapered front obstructing element 53 which is integrally formed with the front end portion of the bottom surface of the top wall 51 and which is located in the T-shaped guideway 523. The front obstructing element 53 has an inclined bottom surface 531 and a vertical rear end surface 532 that has a lower end connected to the lower end of the bottom surface 531. The armrest member further includes a rear obstructing element 54 which is integrally formed With the rear end portion of the bottom surface of the top wall 51 and which is positioned between the guide bodies 52 so as to confine the top end of the connector 4 between the vertical rear end surface 532 of the front obstructing elements 53 and the rear obstructing element 54. In assembly of the connector 4 and the armrest member 5, the connector 4 can be forced to slide over the inclined bottom surface 531 of the front obstructing element 53 into the space in the armrest member 5 between the front and rear obstructing elements 53, 54.

Figure 6:
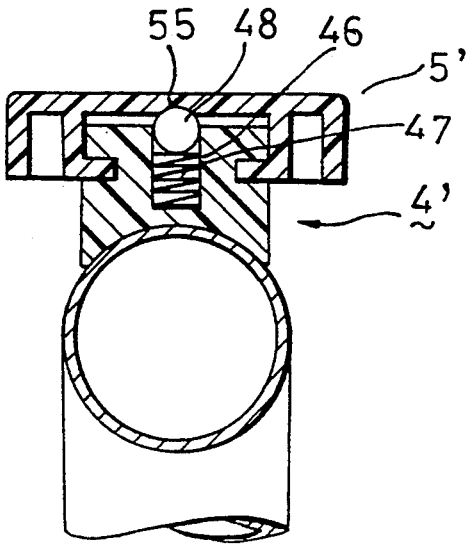
FIG. 6 is a schematic view illustrating another embodiment of the armrest assembly of this invention.

FIG. 6 shows a second embodiment of the armrest assembly of this invention. As illustrated, the armrest member 5' has a cavity 55 formed in the bottom surface of the top wall. The connector 4' includes a bore 46 formed in the top end surface thereof, a coiled compression spring 47 received within the bore 46, and a ball 48 retained on the connector 4' and biased by the spring 47 to engage within the cavity 55 of the armrest member 5' so as to position the armrest member 5' on the connector 4'. It is understood that the number of the cavities 55 can be increased so that a lengthwise row of cavities is formed in the armrest member 5'. In this case, the spring-biased ball 48 can be engaged within a selected one of the cavities 55 so that the position of the armrest member 5' relative to the connector 4' can be adjusted.

With this invention thus explained, it is apparent that numerous modifications and variations can be made without departing from the scope and spirit of this invention. It is therefore intended that this invention be limited only as indicated in the appended claims.

I claim:

1. An adjustable armrest assembly for a chair, the chair including a seat on which the armrest assembly is disposed, said armrest assembly comprising:

an elongated connector adapted to be mounted on the seat and having two opposite side surfaces formed with a respective open-ended horizontal slide slot, said slots being aligned with each other; and an elongated armrest member having a horizontal top wall, and two generally L-shaped guide bodies disposed on two opposite side portions of said top wall, each of said guide bodies including a vertical plate portion secured to a bottom surface of said top wall at a top end portion thereof, and a horizontal plate portion connected securely to said vertical plate portion, said horizontal plate portions being respectively and slidably engaged with said slide slots of said connector so that said armrest member can be moved on said connector.

2. An adjustable armrest assembly as claimed in claim 1, wherein said guide bodies of said armrest member define therebetween a generally T-shaped guideway, said armrest member including a rear obstructing element which projects downward from a rear end portion of the bottom surface of said top wall and which is positioned between said guide bodies so as to prevent said armrest member from forward movement on said connector, and a tapered plastic front obstructing element which is secured to and which extends from a front end portion of the bottom surface of said top wall into said T-shaped guideway and which has a vertical rear end surface and an inclined bottom surface that has a lower end connected to a lower end of said vertical rear end surface, a top end of said connector being positioned and confined between said front and rear obstructing elements, said connector sliding over said inclined bottom surface of said tapered front obstructing element into a space in said armrest member between said front and rear obstructing elements during assembly of said armrest member and said connector.

* * * * *